United States Patent [19]

Kappell et al.

[11] 4,245,821

[45] Jan. 20, 1981

[54] REFINING FURNACE FOR NONFERROUS METAL

[75] Inventors: Gerhard Kappell, Jesteburg; Klaus P. Hugk, Hamburg, both of Fed. Rep. of Germany

[73] Assignee: Norddeutsche Affinerie, Hamburg, Fed. Rep. of Germany

[21] Appl. No.: 65,107

[22] Filed: Aug. 9, 1979

[30] Foreign Application Priority Data

Aug. 25, 1978 [DE] Fed. Rep. of Germany ..... 2837160

[51] Int. Cl.[3] ..... C21B 13/08; F27B 7/02

[52] U.S. Cl. ..... 266/163; 266/173; 266/213; 75/72

[58] Field of Search ..... 266/145, 173, 163, 213; 75/72–76

[56] References Cited

U.S. PATENT DOCUMENTS

| | | | |
|---|---|---|---|
| 3,772,001 | 11/1973 | Larson | 75/76 |

FOREIGN PATENT DOCUMENTS

| | | | |
|---|---|---|---|
| 810432 | 8/1951 | Fed. Rep. of Germany | 75/38 |
| 2061388 | 6/1972 | Fed. Rep. of Germany | 75/72 |
| 428378 | 5/1935 | United Kingdom | 75/72 |
| 1115404 | 5/1968 | United Kingdom | 266/163 |

*Primary Examiner*—M. J. Andrews
*Attorney, Agent, or Firm*—Karl F. Ross

[57] ABSTRACT

A furnace for the refining of nonferrous metal such as copper comprising a drum structure rotatable about a substantially horizontal axis and formed along the same side of the shell with a tapping box for discharging the molten metal and a slag-discharging weir, the interior of the furnace being subdivided into two chambers communicating respectively with the weir and with the tapping box. The partition is formed with a port interconnecting the molten metal baths in the chambers below the levels thereof to form a siphon.

8 Claims, 3 Drawing Figures

REFINING FURNACE FOR NONFERROUS METAL

FIELD OF THE INVENTION

The present invention relates to a furnace for the refining of nonferrous metals, and more particularly to a drum-type furnace for the refining of such nonferrous metals as copper.

BACKGROUND OF THE INVENTION

In the refining of nonferrous metals, it is common to remove impurities from the molten metal by a so-called "fire-refining process" whereby the metal is first oxidized by treatment with air, oxygen-enriched air or oxygen, thereby volatilizing or slagging the impurities and forming small amounts of metal oxide which is dissolved in the charge of molten metal with which the process starts. The metal oxide is reduced by poling or other treatment of the molten metal bath with a pulverulent or liquid reducing agent or by reducing gases.

The two processes can be carried out successively in a single unit, thereby resulting in batch production of the refined mteal, or can be carried out intermittently or continuously in two separate units, one of which serves for the oxidation of the impurities while the other carries out the reducing step.

In the refining of copper (see German Pat. No. 810,432) it is known to use a rotatable drum furnace which is charged with the liquid copper and is subdivided internally by a partition into an oxidizing chamber and a reducing chamber, means being provided to remove the slag while a siphon is formed in the partition or by the partitions to separate the oxidizing and reducing chamber.

More specifically, the slag is discharged through a slag hole in the shell or wall of the drum forming the furnace while the refined copper is discharged into a separate collecting vessel, on wheels, through a discharge spout provided in an end wall of the furnace.

This system has the disadvantage that it cannot be operated continuously since, when the collecting vessel is filled, the collecting unit must be separated from the remainder of the installation and wheeled into the foundry for discharge.

Consequently, the delivery of copper from this unit and the charging of metallic copper into the unit is interrrupted for the period this requires.

Another disadvantage of the earlier system is that it generally must be constructed in small units to facilitate mobility and hence the semibatch process which results does not afford a constant quality of the copper produced over a long operating period.

OBJECTS OF THE INVENTION

The principal object of the present invention is to provide an improved refining furnace for nonferrous metals which avoids the drawbacks of prior art furnaces and yields a nonferrous metal of consistent quality for long periods of time.

A more specific object of the invention is to provide a refining furnace of relatively low cost and facile operation which enables continuous refining of a nonferrous metal of virtually constant quality.

Yet another object of this invention is to provide an improved copper-refining furnace which provides for two stages of refining of molten copper and yet does not need to be moved from place to place, can be of relatively large size, and is of simpler design than earlier furnaces for this purpose.

SUMMARY OF THE INVENTION

These objects and others which will become apparent hereinafter are attained, in accordance with the present invention, in a refining furnace for nonferrous metal, especially copper, which comprises a furnace drum rotatable about its axis which is generally horizontal, i.e. recumbent, with the cylindrical wall or shell of the furnace being formed at axially spaced apart locations but generally along the same generatrix and hence along the same side with slag-removal means and means for discharging the refined melt. The interior of the furnace is partitioned between these means by a substantially vertical or upstanding partition formed with or as a siphon communicating between the oxidation chamber on one side of this partition and the reducing chamber on the opposite side thereof.

According to the invention, therefore, the rotatable furnace comprises means for charging molten (liquid) metal into a drum of the furnace, advantageously at one axial end thereof, an oxidizing chamber formed in the furnace drum adjacent this charging means and communicating therewith for receiving the molten metal charge, slag-removing means in the shell or cylindrical wall of the furnace drum in this chamber, an upright partition formed with a siphon at the opposite end of this chamber and within the furnace drum, a reducing chamber formed in the drum downstream of the partition and communicating with the oxidizing chamber through the aforementioned siphon, metal-tapping means in the shell or cylindrical wall of the furnace on the same side as the slag-discharge means, means for rotating the furnace drum about its axis to vary the height of the liquid level therein, and means for discharging gases from the furnace drum, advantageously at an axial end thereof. In this structure, the metal-tapping means and the slag-removing means are provided on the same side of the furnace and advantageously the outlet from the furnace of the melt-tapping means can be disposed angularly below the slag-discharge weir forming part of the slag-removal means.

Because the slag-removing means and the metal-tapping means are disposed at the same side of the cylindrical wall of the rotatable refining furnace the oxidizing and the reducing treatments can be carried out with various degrees of filling of the furnace and the respective chambers, the filling degrees varying over a wide range.

Thus the refining furnace also serves as a collecting vessel and has a substantial buffer capacity for differences in the rates at which the metal is charged and tapped. This has been found to insure a consistency in the refined metal quality unattainable with the earlier systems described.

For example, when the refining furnace is rotated to raise the slag-removal means (especially the overflow weir) and the metal-tapping means (especially its discharge hole) the furnace may be charged with metal to a greater degree or metal may be discharged at a lower rate or not at all. On the other hand, rotation of the furnace in the opposite sense to lower the weir and the tapping hole can result in a discharge of the refined metal at a higher rate or the refining of smaller quantities of metal which can be introduced at a lower rate into the furnace or even to discharge molten metal with interruption of the charging of molten metal into the oxidizing chamber. The refining furnace of the present invention can be operated when filled to between 30% to 100% of capacity.

Another advantage of the refining furnace of the present invention is that it enables refining to be commenced even at a low degree of filling, e.g. after a relatively brief waiting time following the commencement of the filling or charging operation. In other words the furnace can be placed in operation for a refining process more rapidly then might otherwise have been expected.

In the refining furnace of the invention, the oxidizing and reducing treatments are carried out conventionally. For example, the oxidation is effected by a treatment with air, oxygen-enriched air or commercially pure oxygen.

The reducing operation is carried out by poling agents such as pulverulent reducing agents (e.g. coal) or liquid reducing agents (e.g. liquid hydrocarbon), or with carbon monoxide or with reformed or non-reformed hydrocarbon gases. The reactants can be introduced through nozzles, preferably arranged in rows or through lances which can be water cooled. Such expedients are conventional in the art.

According to a feature of the invention, the metal tapping means comprises a discharge box attached to the shell or cylindrical wall of the furnace drum and extending substantially at a right angle to the axis thereof. This box, which can communicate laterally with the discharge hole, can have an outlet at its bottom which is closed by a plug and forms a valve for precise control of the rate at which the copper or other nonferrous metals are discharged.

According to another feature of the invention, means is provided for tilting the furnace, i.e. adjusting the angle included between the axis of the furnace and the vertical. While normally this angle is 90°, one end, e.g. the reducing end, can be raised and lowered by this means to permit optimum adjustment of the location of the slag-removing means and the metal tapping means and, therefore, the thickness of the slag layer in the oxidizing zone, depending upon the operating conditions.

In yet another feature of the invention, at least one burner is mounted in the end wall of the furnace drum opposite the inlet for the molten metal. This permits adjustment of the temperature in the furnace and adjustment of the atmosphere to an oxidizing or reducing atmosphere by varying the fuel/air ratio supplied to the burner.

It has been found to be desirable to provide the exhaust gas opening and the molten-metal feed means at the same end of the furnace drum and, in this case, it is advantageous to provide the exhaust gas opening at this end and to have the liquid metal feed means, e.g. trough, extend into the oxidizing zone through this opening. Thus a portion of the sensible heat of the exiting gases will be transferred to the incoming liquid metal and is more effectively utilized.

While the furnace of the present invention can be used to treat all nonferrous metals which must be subjected to oxidation and reduction, it is especially effective for the refining of copper.

BRIEF DESCRIPTION OF THE DRAWING

The above and other objects, features and advantages of the present invention wil become more readily apparent from the following description, reference being made to the accompanying drawing in which.

SPECIFIC DESCRIPTION

Figure 1:
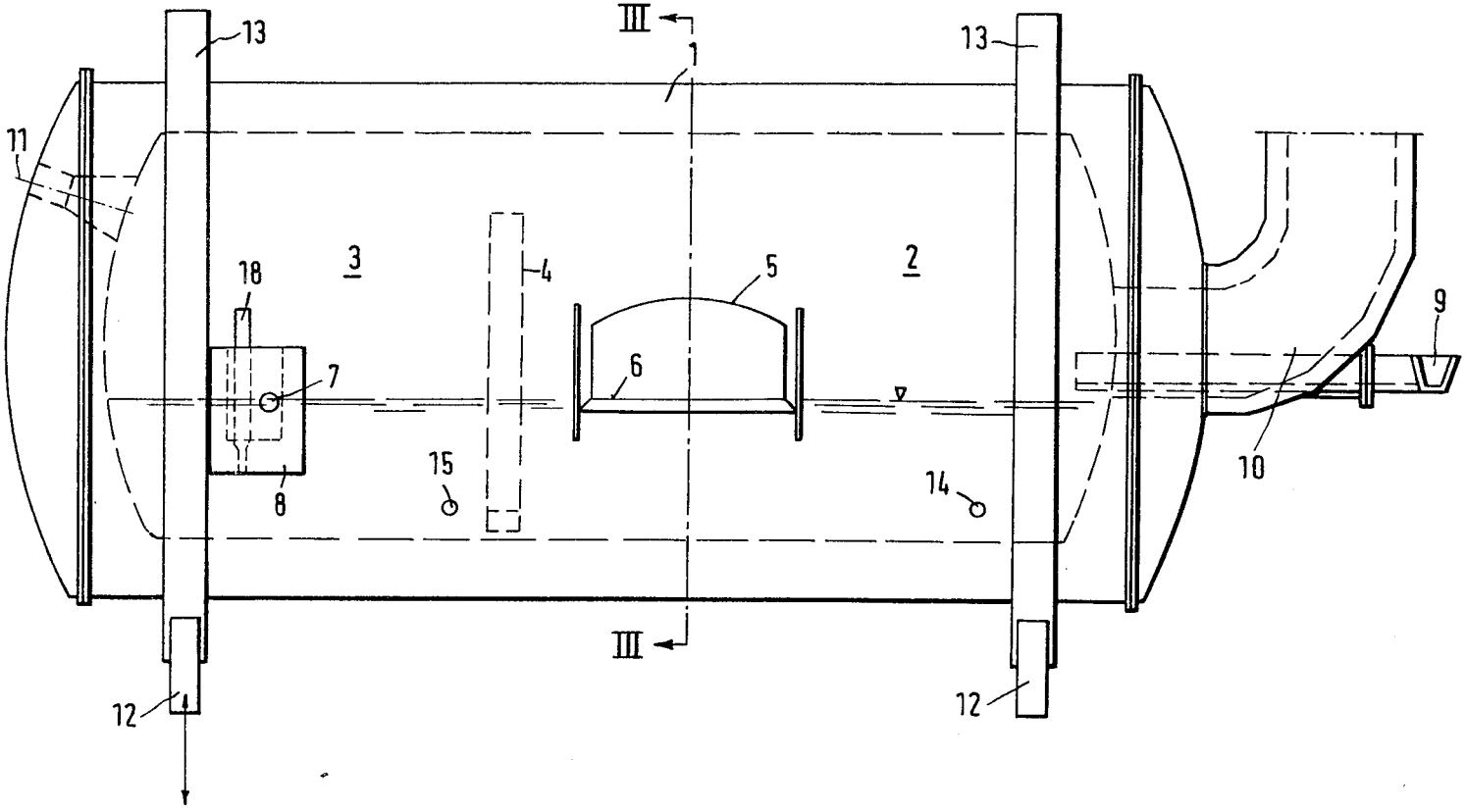
FIG. 1 is a side elevational view diagrammatically illustrating a furnace in accordance with the present invention.

The refining furnace shown in the drawing comprises a furnace drum 1 which can be seen to have a general horizontal axis and can be of conventional construction, e.g. formed with a cylindrical metal shell and a pair of outwardly domed ends, being internally lined with a refractory. The furnace is internally subdivided by an upright partition 4 into an oxidizing chamber 2 and a reducing chamber 3 which communicate through a siphon formed by the partition 4 which, for this purpose, can have a port **4*a*** communicating between the chambers.

The slag-removing means communicating with the oxidizing chamber 2 is designated at 5 and includes a window formed in the cylindrical wall of the furnace (see FIG. 3) and provided with a slag weir 6 which can be supported on brackets **6*a* flanking the weir and the discharge opening 5**.

The metal-tapping means 7 comprises a discharge box which is mounted on the wall of the drum 1 in the region of the reducing chamber 3 and extends generally perpendicularly to the axis of the drum. The box 8 is provided with a downwardly open discharge hole **8*a*, which can be closed by a plug 18 and communicates with the topping hole 7*a* in the wall of the drum. Another opening 17 can be provided in the box 8 at the level of the hole 7*a* in order to open the latter. After this the hole 17** is closed by a plug (not shown).

Molten metal is charged into the furnace through a feed means represented by the trough 9 which extends through the outlet port for the exhaust gases which communicate with the gas duct 10.

At the other end of the furnace drum, a burner 11 is provided as previously described.

The drum 1 is provided with support rings 13 which are rotatably supported on rollers 12 having a suitable drive for angularly displacing the drum and hence tilting the positions of the metal tapping means and the weir. Oxidizing and reducing gases are introduced into the melt in chambers 2 and 3, respectively, by nozzles 14 and 15 which have been diagrammatically illustrated and which open below the level of the melt in each instance.

Figure 2:
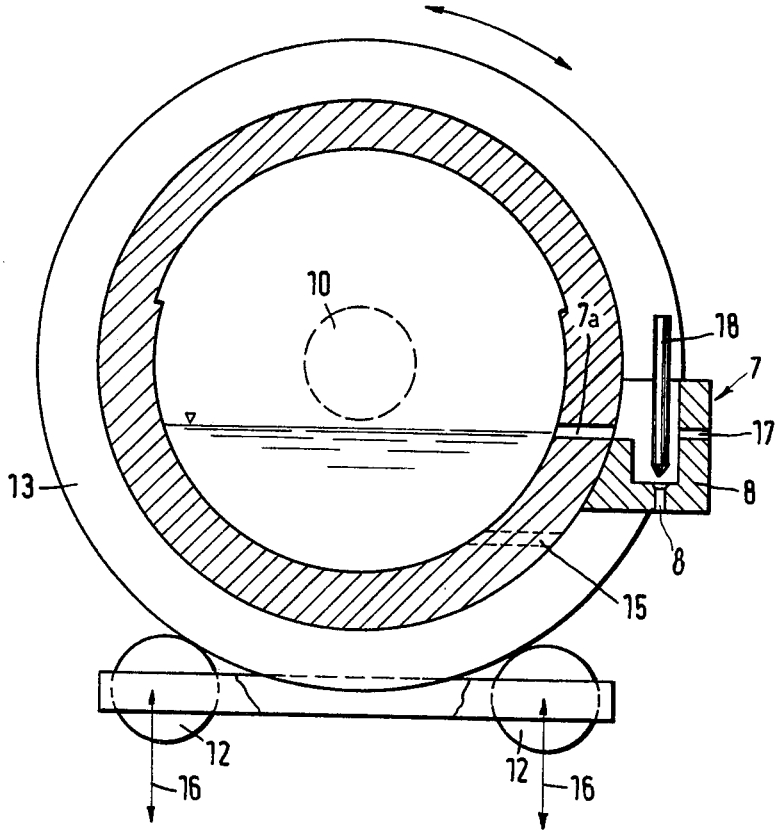
FIG. 2 is a diagrammatic cross-section view through this furnace.
Figure 3:
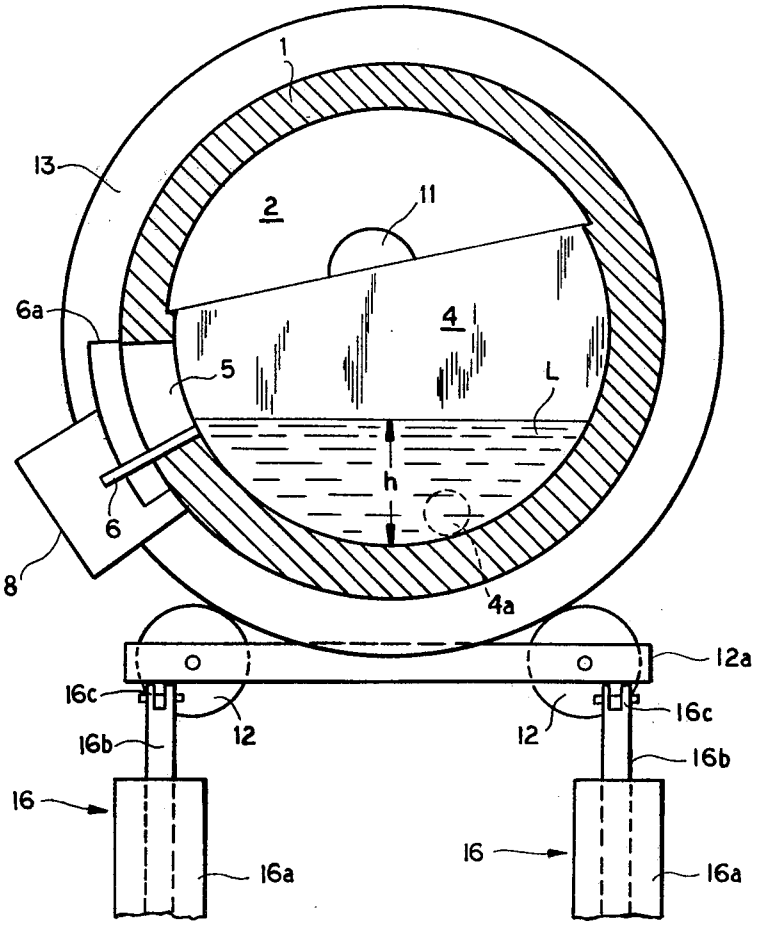
FIG. 3 is a cross section through another portion thereof, taken along the line III—III of FIG. 1.

As represented by the arrow 16 in FIG. 2 and as shown in greater detail in FIG. 3, tilting means can be provided for raising and lowering the discharge end of the furnace, i.e. for swinging the axis of the furnace in a vertical plane.

More particularly, the rollers 12 at this end may have a support beam **12*a* which is articulated at 16*c* to a pair of pistons 16*b* of cylinder 16*a*** which can be charged with a fluid under pressure for the raising and lowering operation.

In operation, the molten metal is introduced into the oxidizing chamber 2 and at a level determined by the weir, is subjected to oxidation. The molten metal passes at a rate equivalent to the rate of introduction, through the siphon formed by wall 4 and part **4*a* into the chamber 3 where it is subjected to a reduction treatment and the molten metal can be tapped. As a comparison of FIG. 2 with FIG. 3 will show, the height h of the molten metal in each chamber can be adjusted by rotating the furnace drum about its axis, thereby raising or lowering the weir 6** and the tapping hole.

SPECIFIC EXAMPLE

The refining furnace 1 used for this Example had an overall length of 9.50 meters and an inside diameter of 3.50 meters. The oxidizing chamber 2 had a length of 6.50 meters and the reducing chamber a length of 3.00 meters. The maximum degree of filling of the refining furnace 1 corresponded to a charge of 250 metric tons and was limited by the exhaust gas duct 10, which was centrally disposed in an end wall.

When the refining furnace 1 had been preheated by the burner 11 and had been put into operation, the furnace was charged via the charging means 9 with 30 metric tons/h of copper that had been melted in a shaft furnace. When the furnace had been rotated so that the slag-removing means 5 were on a relatively low level, it was possible to initiate the oxidizing treatment when the furnace contained a charge of 80 metric tons. For such oxidizing treatment 200 standard $m^3/h$ of air were fed via the nozzle 14. Through an opening in the partition 4, the copper flowed into the reducing chamber 3. It was possible to initiate the reducing process in the chamber 3 also after relatively short time. For the reducing process, 600 standard $m^3$ methane per hour were fed through the nozzle 15.

To allow for the increasing copper content, the refining furnace 1 was rotated accordingly. At the same time, slag flowing over the slag weir 6 of the slag-removing means 5 was removed continuously or in short intervals of time at a rate of 1000 kg/h.

The casting of anodes was begun when the refining furnace 1 had been filled with 250 metric tons of copper. For this purpose, the tapping means 7 were opened and the plug 18 of the discharge box 8 was pulled. Amounting to 50 metric tons per hour, the pouring rate exceeded the rate at which copper was charged. To take the decrease of copper into account, the refining furnace 1 was roated so that it was possible to remove slag continuously or in short intervals of time through the slag-removing means 5.

After six hours, when the furnace contained 130 metric tons, the pouring was discontinued for 4 hours. During that time, the quantity of copper in the refining furnace increases to 250 metric tons.

Because copper of virtually constant quality was charged at a constant rate, it was possible to feed gases at constant rates to the oxidizing chamber 2 and the reducing chamber 3 throughout the process.

We claim:

1. A furnace for the refining of a liquid nonferrous metal, comprising:

a furnace drum having a generally recumbent axis and a pair of axially spaced ends;

a partition in said drum subdividing the interior thereof into an oxidizing chamber at an upstream one of said ends, said partition forming a siphon for communicating between molten metal baths in said chamber, said drum having an angular wall between said ends;

means for rotating said drum about its axis;

means for introducing liquid metal into said oxidizing chamber through said upstream one of said ends;

means for introducing an oxidizing medium into the melt in said oxidizing chamber and a reducing medium into the melt in said reducing chamber;

slag-removing means formed in said wall in the region of said oxidizing chamber for discharging slag from atop the melt therein;

melt-tapping means formed in said wall at the same side of said drum as said slag-removal means with respect to said axis and communicating with the reducing chamber at a location below said slag-removal means; and means for discharging a gas from said drum.

2. The refining furnace defined in claim 1, further comprising tilting means for swinging the axis of said drum in a vertical plane.

3. The refining furnace defined in claim 1, further comprising a burner in said downstream end of said drum.

4. The refining furnace defined in claim 1 or claim 4 wherein the means for discharging gas from said furnace has an outlet opening in said upstream end of said furnace and the means for feeding liquid metal to the furnace extends through this latter opening.

5. A furnace for the refining of a liquid nonferrous metal, comprising:

a furnace drum having a generally recumbent axis and a pair of axially spaced ends;

a partition in said drum subdividing the interior thereof into an oxidizing chamber at an upstream one of said ends, said partition forming a siphon for communicating between molten metal baths in said chamber, said drum having an angular wall between said ends;

means for introducing liquid metal into said oxidizing chamber through said upstream one of said ends;

means for introducing an oxidizing medium into the melt in said oxidizing chamber and a reducing medium into the melt in said reducing chamber;

slag removal means formed in said wall in the region of said oxidizing chamber for discharging slag from atop the melt therein;

melt-tapping means formed in said wall at the same side of said drum as said slag-removal means and communicating with the reducing chamber at a location below said slag-removal means, said melt-tapping means including:

a melt outlet hole formed in said wall and communicating with said reducing chamber, a discharge box receiving molten metal from said hole, an outlet formed in said box, and a plug for closing said outlet, said box lying substantially at a right angle to the axis of said drum; and means for discharging gas from said drum.

6. The refining furnace defined in claim 5, further comprising tilting means for swinging the axis of said drum in a vertical plane.

7. The refining furnace defined in claim 5, further comprising a burner in said downstream end of said drum.

8. The refining furnace defined in claim 5, claim 6 or claim 7 wherein the means for discharging gas from said furnace has an outlet opening in said upstream end of said furnace and the means for feeding liquid metal to the furnace extends through this latter opening.

* * * * *